US010161161B2

(12) United States Patent
Yin et al.

(10) Patent No.: US 10,161,161 B2
(45) Date of Patent: Dec. 25, 2018

(54) ENCLOSING WALLBOARD FIRM-CONNECTION DEVICE

(71) Applicants: Jihong Yin, Shandong (CN); Xiaochen Hu, Shandong (CN); Yunqi Zhao, Shandong (CN); Jiabin Zhao, Shandong (CN)

(72) Inventors: Jihong Yin, Shandong (CN); Xiaochen Hu, Shandong (CN); Yunqi Zhao, Shandong (CN); Jiabin Zhao, Shandong (CN)

( * ) Notice: Subject to any disclaimer, the term of this patent is extended or adjusted under 35 U.S.C. 154(b) by 487 days.

(21) Appl. No.: 15/011,585

(22) Filed: Jan. 31, 2016

(65) Prior Publication Data

US 2016/0362909 A1 Dec. 15, 2016

(30) Foreign Application Priority Data

Jun. 12, 2015 (CN) ..... 2015 2 0416283 U

(51) Int. Cl.
*E04H 17/22* (2006.01)
*E04H 12/22* (2006.01)
(Continued)

(52) U.S. Cl.
CPC ..... *E04H 17/16* (2013.01); *E04H 12/2269* (2013.01); *E04H 15/62* (2013.01);
(Continued)

(58) Field of Classification Search
CPC .... E02D 5/80; E04F 11/1812; E04F 11/1814; E04H 12/2269; E04H 12/2276;
(Continued)

(56) References Cited

U.S. PATENT DOCUMENTS 1,898,297 A * 2/1933 Fox ..... A63H 33/105 446/105
5,628,495 A * 5/1997 Gandara ..... E04H 17/165 256/24
(Continued)

FOREIGN PATENT DOCUMENTS

CA 2394995 A1 * 1/2004 ..... E04H 17/168
CH 325758 A * 11/1957 ..... E04H 12/2276
(Continued)

*Primary Examiner* — Josh Skroupa
(74) *Attorney, Agent, or Firm* — Gokalp Bayramoglu

(57) ABSTRACT

An enclosing wallboard firm-connection device includes an enclosing wall, a column body and a door. The column body is mounted on the enclosing wall, the door is mounted on the column body. The enclosing wall consists of enclosing wallboards, a lower end cap is mounted at lower end of the enclosing wall, a connecting piece is mounted on the lower end cap. The enclosing wallboards are inserted into the connecting piece, bumps are arranged at upper ends of the enclosing wallboards, grooves are formed in lower ends of the enclosing wallboards. The enclosing wallboards are combined together. The fence is mounted at upper end of the enclosing wall, protection strips are mounted on upper and lower edges of the fence, the connecting piece is mounted at upper end of the protection strip, and an upper end cap is mounted at upper end of the connecting piece.

9 Claims, 8 Drawing Sheets

(51) Int. Cl.

| | |
|---|---|
| ***E06B 11/02*** | (2006.01) |
| ***E04H 17/16*** | (2006.01) |
| ***E04H 17/14*** | (2006.01) |
| ***E06B 9/24*** | (2006.01) |
| ***E06B 3/70*** | (2006.01) |
| ***E04H 15/62*** | (2006.01) |

(52) U.S. Cl.
CPC ..... *E04H 17/1408* (2013.01); *E04H 17/22* (2013.01); *E06B 3/7003* (2013.01); *E06B 9/24* (2013.01); *E06B 11/02* (2013.01); *E06B 11/021* (2013.01)

(58) Field of Classification Search
CPC . E04H 12/2292; E04H 17/1408; E04H 17/16; E04H 17/165; E04H 17/168; E04H 17/18; E04H 17/22; E04H 2017/006; E04H 2017/1456; E06B 3/7003; E06B 9/24; E06B 11/02; E06B 11/028; Y10T 403/64–403/648
USPC ..... 256/24, 31, 65.14, 73; 403/335–338
See application file for complete search history.

(56) References Cited

U.S. PATENT DOCUMENTS 5,864,997 A * 2/1999 Kelly ..... A01G 9/14 52/282.2
7,040,605 B2 * 5/2006 Lappen ..... E04H 17/16 136/245
7,104,525 B2 * 9/2006 Ricci ..... E04H 12/2292 256/1
7,503,550 B2 * 3/2009 Liefke ..... E04H 12/2223 256/24
8,511,648 B2 * 8/2013 McCarthy ..... E04H 17/1404 256/19
9,366,055 B1 * 6/2016 Wright ..... E04H 17/00
9,506,270 B2 * 11/2016 Knudsen ..... E04H 17/165
9,790,685 B2 * 10/2017 Brandt ..... E04F 15/02038
2004/0051093 A1 * 3/2004 Manning ..... E04H 17/168 256/65.01
2006/0113517 A1 * 6/2006 Colantonio ..... E04H 17/168 256/24
2007/0181865 A1 * 8/2007 Hein ..... E04H 17/16 256/24
2008/0179580 A1 * 7/2008 McGinness ..... E04H 17/16 256/59
2009/0152523 A1 * 6/2009 Erwin ..... E04H 17/16 256/24
2009/0224222 A1 * 9/2009 Dezen ..... E04F 11/1817 256/59
2010/0237308 A1 * 9/2010 Lo ..... E04H 17/1417 256/26
2010/0314596 A1 * 12/2010 Thomas ..... E04H 17/16 256/19
2013/0272777 A1 * 10/2013 Hayter ..... E06B 3/9645 403/205
2016/0069101 A1 * 3/2016 Pooch ..... E04H 17/168 256/31

FOREIGN PATENT DOCUMENTS

FR 751015 A * 8/1933 ..... E04H 12/2276
FR 2958674 A3 * 10/2011 ..... E04H 17/1413
FR 3005079 A1 * 10/2014 ..... E04H 17/168
WO WO-20100969206 A1 * 9/2010 ..... E04H 17/1404

* cited by examiner

ENCLOSING WALLBOARD FIRM-CONNECTION DEVICE

TECHNICAL FIELD

The invention relates to a novel enclosing wallboard firm-connection device, and belongs to the field of courtyard protection.

BACKGROUND

Along with continuous improvement of social economy, people have higher requirements on courtyard protection. However, construction and design of most of existing courtyard enclosure fences are relatively original and uncreative. Enclosing wallboard manufacturing and mounting processes are complex and extremely low in mounting efficiency. Moreover, site construction time is long.

Existing wooden enclosing wallboards on the market usually adopt mortise and tenon structures and are constructed on the site, which may cause high time and labour consumption and high construction cost. For existing plastic-wood enclosing wallboards on the market, a factory production manner is adopted, but an existing mounting and fixing manner still has many shortcomings, such as infirmness of the enclosing wallboards which are constructed on the site, damage to the original structure during secondary use, resource waste and disadvantages for environmental protection.

SUMMARY

The technical problem to be solved by the invention is how to overcome the shortcomings of the prior art and to provide a novel enclosing wallboard firm-connection device which can be mounted without a skilled constructor.

The technical solution of the invention is implemented as follows: a novel enclosing wallboard firm-connection device is provided, which includes an enclosing wall, a column body and a door, wherein the column body is mounted on the enclosing wall, and the enclosing wall consists of a plurality of enclosing-wallboards.

A lower end cap is mounted at the lower end of the enclosing wall, a connecting piece is mounted on the lower end cap, the enclosing-wallboards are inserted into the connecting piece, bumps are arranged at the upper ends of the enclosing wallboards, grooves are formed in the lower ends of the enclosing wallboards, the enclosing wallboards are combined together through the bumps and the grooves, a fence is mounted at the upper end of the enclosing wall, protection strips are mounted on the upper and lower edges of the fence, a connecting piece is mounted at the upper end of the protection strip on the upper edge of the fence, an upper end cap is mounted at the upper end of the connecting piece, and the connecting piece is inserted into the upper end cap; and the protection strip on the lower edge of the fence is mounted on the enclosing wallboards through the connecting piece, a plurality of oblique grooves are formed in the protection strip, and the protection strip is mounted on the fence through the oblique grooves.

Furthermore, a bump is arranged on one side of each enclosing wallboard, a groove is formed in the other side of each enclosing wallboard, and the enclosing wallboards are mounted together in a left-right direction through the bumps and the grooves.

Furthermore, the door is connected with the column body through hinges.

Furthermore, the door consists of a doorframe and a door sheet, the doorframe is fixed through L-shaped connecting pieces, and the door sheet is directly fixed on the doorframe.

Furthermore, the connecting piece includes a component a and a component b, the component a is shaped like a Chinese character "Gong", upper and lower transverse branches of the component a are provided with toothed bumps, grooves matched with the toothed bumps are formed in the component b, and a rectangular groove is formed in the lower end of the component b.

Furthermore, the upper end cap includes a master piece and two sub pieces, each sub piece is shaped like a Chinese character "Gong", upper and lower transverse branches of each sub piece are provided with toothed bumps, grooves matched with the toothed bumps are formed in the left and right sides of the master piece, and a rectangular groove is formed in the lower end of the master piece.

Furthermore, a vertical protection strip is arranged on the right side edge of the fence, a vertical connecting piece is arranged outside the vertical protection strip, the vertical connecting piece is connected with the connecting piece at the upper end of the fence through an L-shaped connecting piece, one end of the L-shaped connecting piece is inserted into the connecting piece, and the other end of the L-shaped connecting piece is fixed on the vertical connecting piece through a bolt.

Furthermore, a base is arranged at the lower end of the column body, the base is positioned underground, the base consists of four embedded parts, the base has a square section, the embedded parts are fixed together through bolts, a lower sealing buckle is mounted at the lower end of the base, and the lower sealing buckle is square, and is matched with the section of the base.

Furthermore, an embedded part end cap is arranged at the upper end of the base, a buckle is arranged on one side of the embedded part end cap, and the embedded part end cap is positioned on the ground.

Furthermore, the L-shaped connecting piece is prepared from aluminium or rigid plastic, and the door and the column body are prepared from aluminium or rigid plastic.

The novel enclosing wallboard firm-connection device is time-saving, labour-saving, convenient to mount and transport and firm in mounting. The bolts are adopted for combination of the novel enclosing wallboard firm-connection device, so that the novel enclosing wallboard firm-connection device can be secondarily used, and has broad market prospect and huge economic benefits, the cost is reduced, the environment is protected, and aesthetics and practicability are combined. The novel enclosing wallboard firm-connection device is directly assembled, so that the parts are convenient to transport, and the novel enclosing wallboard firm-connection device is firm, convenient to mount, time-saving and more practical.

BRIEF DESCRIPTION OF THE DRAWINGS

The invention is further described below with reference to the drawings and embodiments.

DETAILED DESCRIPTION OF THE EMBODIMENTS

A novel enclosing wallboard firm-connection device provided by the invention will be described below with reference to the drawings in detail.

Embodiment 1

Figure 1:
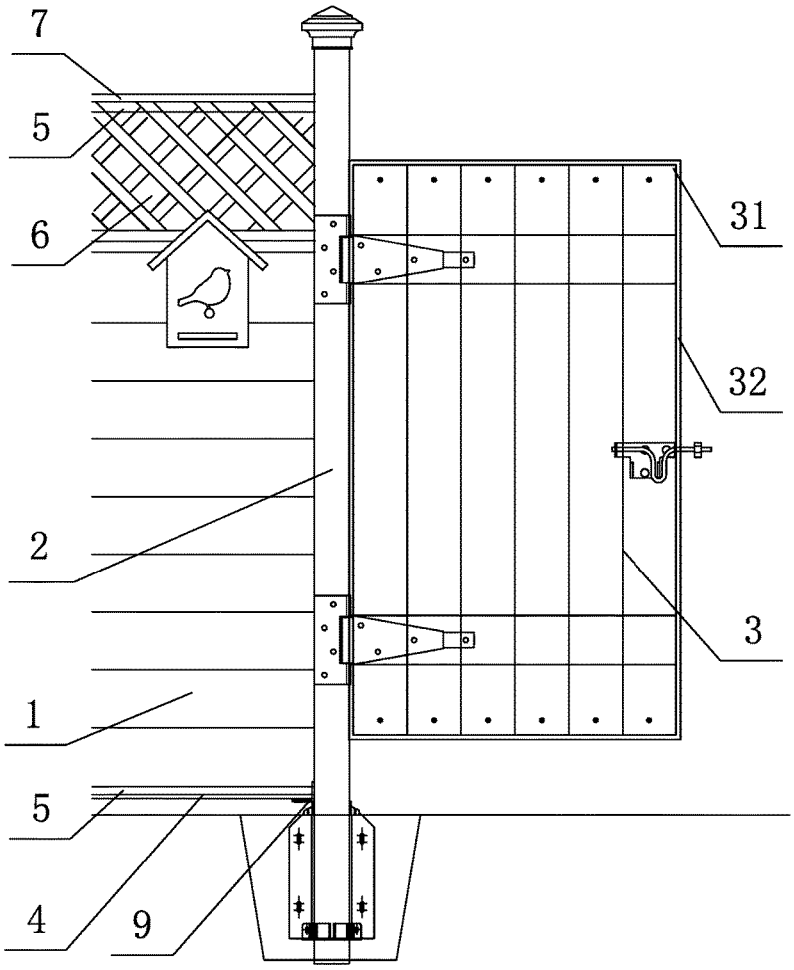
FIG. 1 is a structure diagram of an embodiment of an enclosing wallboard firm-connection device of the present invention.
Figure 2:
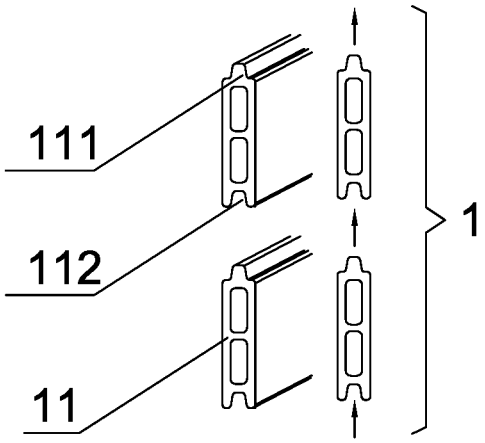
FIG. 2 is a structure diagram of an enclosing wallboard of the embodiment of the present invention.
Figure 3:
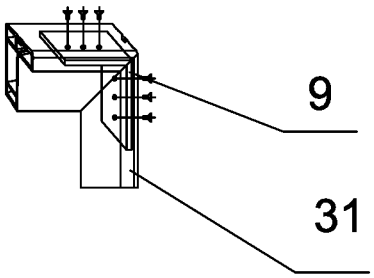
FIG. 3 is a structure diagram of a doorframe of the present invention.
Figure 4:
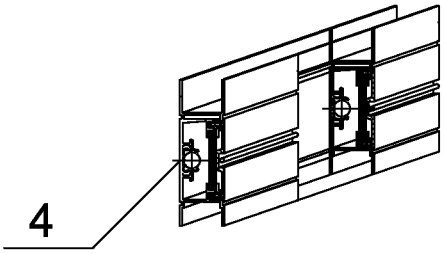
FIG. 4 is a perspective view of a lower end cap of the present invention.
Figure 5:
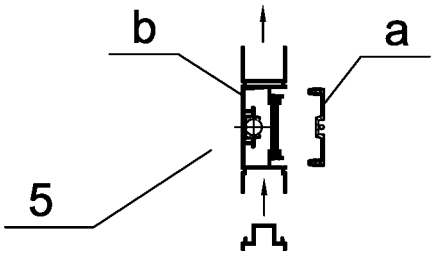
FIG. 5 is a structure diagram of a connecting piece of the present invention.
Figure 6:
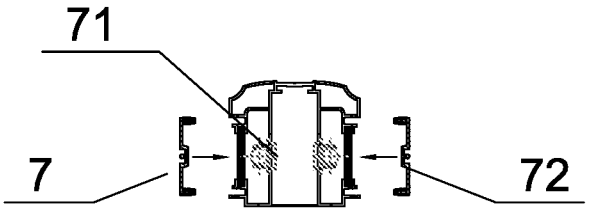
FIG. 6 is a structure diagram of an upper end cap of the present invention.
Figure 7:
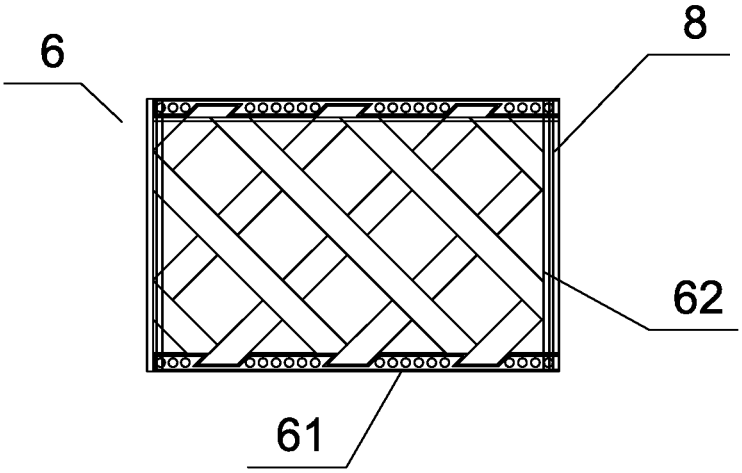
FIG. 7 is a structure diagram of a fence of the present invention.
Figure 8:
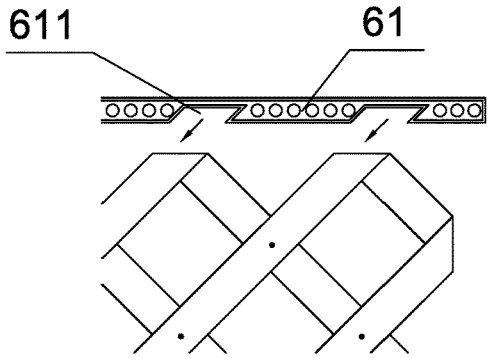
FIG. 8 is a structure diagram of a protection strip of the present invention.
Figure 9:
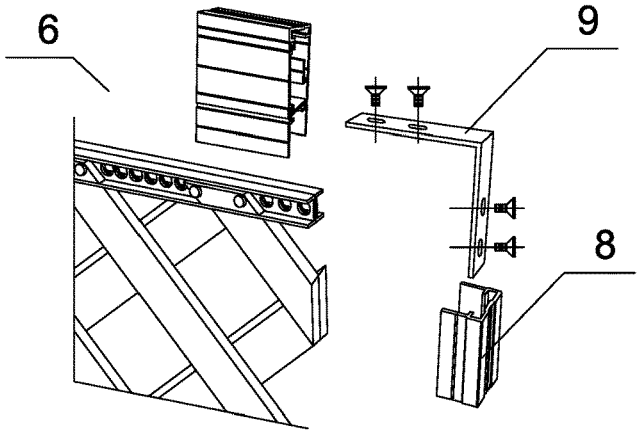
FIG. 9 is a partial exploded view of FIG. 7.
Figure 10:
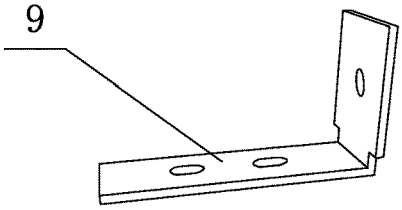
FIG. 10 is a perspective view of an L-shaped connecting piece.
Figure 11:
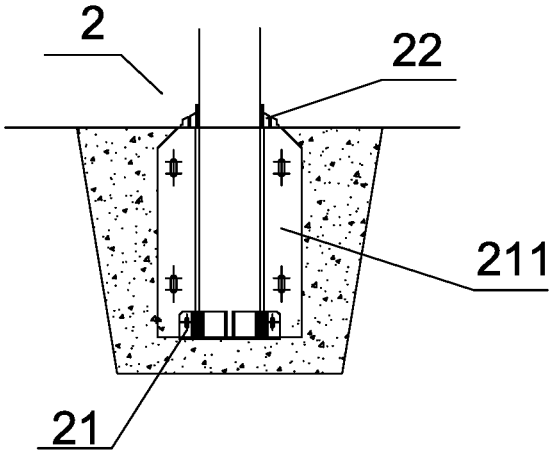
FIG. 11 is a schematic diagram of a bottom of a column body of the present invention.
Figure 12:
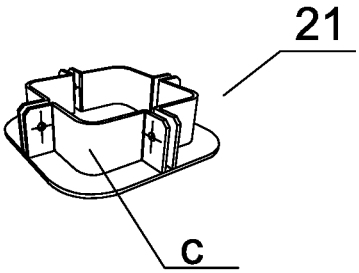
FIG. 12 is a perspective view of a base of the present invention.
Figure 13:
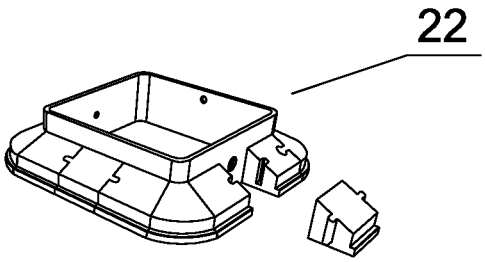
FIG. 13 is a perspective view of an embedded part end cap of the present invention.
Figure 14:
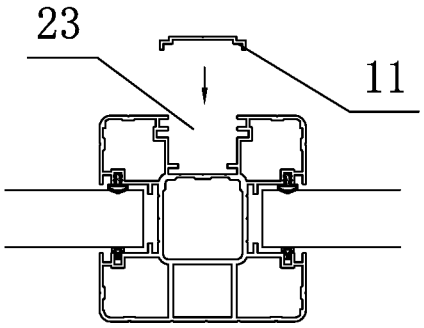
FIG. 14 is a top view of FIG. 11.
Figure 15:
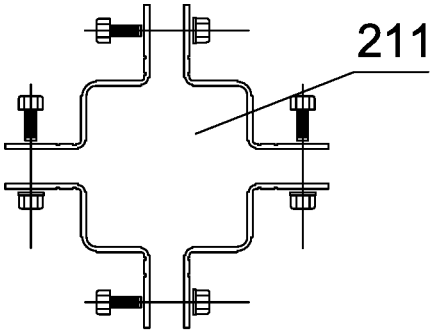
FIG. 15 is a structure diagram of a lower sealing buckle of the present invention.
Figure 16:
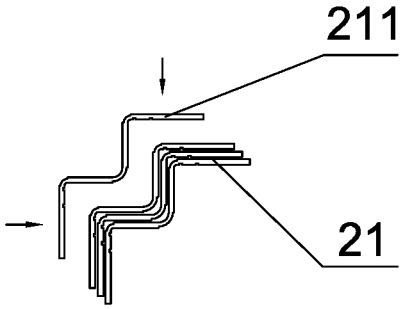
FIG. 16 is a schematic diagram of an assembly of a base and a lower sealing buckle of the present invention.

As shown in FIGS. 1-16, a novel enclosing wallboard firm-connection device includes an enclosing wall 1, a column body 2 and a door 3, wherein the column body 2 is mounted on the enclosing wall 1, the door 3 is mounted on the column body 2, the enclosing wall 1 is prepared from wood or wood-plastic, and the door 3 and the column body 2 are prepared from aluminium or rigid plastic, and can be dismounted and conveniently transported. The enclosing wall 1 consists of a plurality of enclosing wallboards 11, so that simplicity mounting and convenience in transportation are ensured.

A lower end cap 4 is mounted at the lower end of the enclosing wall 1, a connecting piece 5 is mounted on the lower end cap 4, and corners of the lower end cap 4 are connected with the enclosing wallboard 11 through L-shaped connecting pieces 9 to achieve firmness in mounting. A bump is arranged on the connecting piece 5, a groove is formed in the lower end cap 4, the connecting piece 5 is inserted into the lower end cap 4, bumps 111 are arranged at the upper ends of the enclosing wallboards 11, grooves 112 are formed in the lower ends of the enclosing wallboards 11, the enclosing wallboards 11 are combined together through the bumps 111 and the grooves 112, a fence 6 is mounted at the upper end of the enclosing wall 1, protection strips 61 are mounted on the upper and lower edges of the fence 6, the protection strip 61 on the lower edge of the fence 6 is mounted on the enclosing wallboards 11 through the connecting piece 5, a plurality of oblique grooves 611 are formed in the protection strip 61, and the protection strip 61 is mounted on the fence 6 through the oblique grooves 611.

The connecting piece 5 is mounted at the upper end of the protection strip 61 on the upper edge of the fence 6, an upper end cap 7 is mounted at the upper end of the connecting piece 5, and the connecting piece 5 is inserted into a groove of the upper end cap 7, so that stability in connection is ensured.

The door 3 is connected with the column body 2 through hinges, so that flexibility in movement is ensured. The door 3 consists of a doorframe 31 and a door sheet 32, the doorframe 31 is fixed through L-shaped connecting pieces 9, and the door sheet 32 is directly fixed on the door frame 31.

The connecting piece 5 includes a component a and a component b, the component a is shaped like a Chinese character "Gong", upper and lower transverse branches of the component a are provided with toothed bumps, grooves matched with the toothed bumps are formed in the component b, and a rectangular groove is formed in the lower end of the component b, so that the enclosing wallboards 11 or the protection strips 61 can be conveniently inserted.

The upper end cap 7 includes a master piece 71 and two sub pieces 72, each sub piece 72 is shaped like a Chinese character "Gong", upper and lower transverse branches of each sub piece 72 are provided with toothed bumps, grooves matched with the toothed bumps are formed in the left and right sides of the master piece 71, and a rectangular groove is formed in the lower end of the master piece 71, so that the connecting piece 5 can be conveniently inserted. In order to ensure firmness in connection, a vertical protection strip 62 is arranged on the right side edge of the fence 6, a vertical connecting piece 8 is arranged outside the vertical protection strip 62, and a groove connection manner is also adopted. The vertical connecting piece 8 is connected with the connecting piece 5 at the upper end of the fence 6 through an L-shaped connecting piece 9, one end of the L-shaped connecting piece 9 is inserted into the connecting piece 5, and the other end of the L-shaped connecting piece 9 is fixed on the vertical connecting piece 8 through a bolt. Ingenious design and firmness in connection are achieved.

In order to ensure mounting firmness of the column body, a base 21 is arranged at the lower end of the column body 2, the base 21 is positioned underground, the base 21 consists of four embedded parts c, the base 21 has a square section, the embedded parts c are fixed together through bolts, a lower sealing buckle 211 is mounted at the lower end of the base 21, and the lower sealing buckle 211 is square, and is matched with the section of the base 21. An embedded part end cap 22 is arranged at the upper end of the base 21, a buckle is arranged on one side of the embedded part end cap 22, the embedded part end cap 22 is positioned on the ground, and all the structures are intended to ensure firmness of the column body 2, and are precise in design and convenient to mount. The L-shaped connecting piece 9 is prepared from aluminium or rigid plastic, and the door and the column body are prepared from aluminium or rigid plastic. U-shaped grooves 23 are formed in three lateral surfaces of the column body 2, the enclosing wallboards are inserted into the U-shaped grooves 23, and the other grooves may be sealed. A ruler may be mounted in the lower end of the column body 2, and a scale part of the ruler is exposed, so that depth measurement of a mounting worker is facilitated, and simple design and convenience are ensured. In addition, a wiring channel may be formed in the lower edge of the fence 6, a wiring channel may also be formed in the column body 2, wires may penetrate through the wiring channels, and transformers may be arranged on the enclosing wallboards 11 through the wiring channels, so that various lamps, holiday colour lamps, infrared sensors, monitors, intelligent alarming systems and the like can be arranged on the enclosing wall 1. The transformers may be shaped into birdcages or other forms.

Embodiment 2

Figure 17:
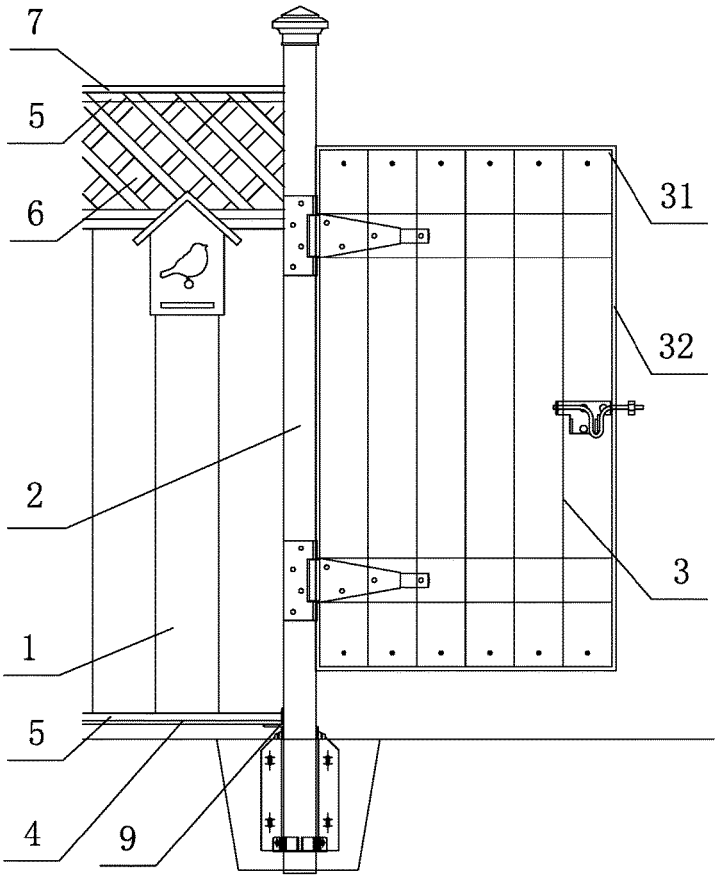
FIG. 17 is a structure diagram of a novel enclosing wallboard firm-connection device of an other embodiment of the present invention.
Figure 18:
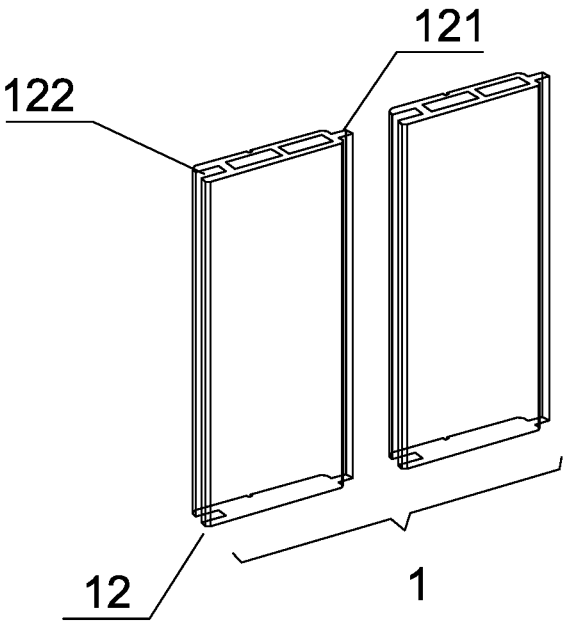
FIG. 18 is a perspective view of an enclosing wallboard of the other embodiment of the present invention.

As shown in FIGS. 7-9 and 11-18, a novel enclosing wallboard firm-connection device includes an enclosing wall 1, a column body 2 and a door 3, wherein the column body 2 is mounted on the enclosing wall 1, the door 3 is mounted on the column body 2, the enclosing wall 1 is prepared from wood or wood-plastic, and the door 3 and the column body 2 are prepared from aluminium or rigid plastic, and can be dismounted and conveniently transported. The enclosing wall 1 consists of a plurality of enclosing wallboards 12, so that simplicity mounting and convenience in transportation are ensured.

A lower end cap 4 is mounted at the lower end of the enclosing wall 1, a connecting piece 5 is mounted on the lower end cap 4, a bump is arranged on the connecting piece 5, a groove is formed in the lower end cap 4, the connecting piece 5 is inserted into the lower end cap 4, bumps 121 are arranged at the upper ends of the enclosing wallboards 12, grooves 122 are formed in the lower ends of the enclosing wallboards 12, and the enclosing wallboards 12 are mounted together in a left-right direction through the bumps 121 and the grooves 122. A fence 6 is mounted at the upper end of the enclosing wall 1, protection strips 61 are mounted on the upper and lower edges of the fence 6, the protection strip 61 on the lower edge of the fence 6 is mounted on the enclosing wallboards 12 through the connecting piece 5, a plurality of oblique grooves 611 are formed in the protection strip 61, and the protection strip 61 is mounted on the fence 6 through the oblique grooves 611.

The connecting piece 5 is mounted at the upper end of the protection strip 61 on the upper edge of the fence 6, an upper end cap 7 is mounted at the upper end of the connecting piece 5, and the connecting piece 5 is inserted into a groove of the upper end cap 7, so that stability in connection is ensured. The door 3 is connected with the column body 2 through hinges, so that flexibility in movement is ensured. The door 3 consists of a doorframe 31 and a door sheet 32, the doorframe 31 is fixed through L-shaped connecting pieces 9, and the door sheet 32 is directly fixed on the door frame 31.

The connecting piece 5 includes a component a and a component b, the component a is shaped like a Chinese character "Gong", upper and lower transverse branches of the component a are provided with toothed bumps, grooves matched with the toothed bumps are formed in the component b, and a rectangular groove is formed in the lower end of the component b, so that the enclosing wallboards 12 or the protection strips 61 can be conveniently inserted.

The upper end cap 7 includes a master piece 71 and two sub pieces 72, each sub piece 72 is shaped like a Chinese character "Gong", upper and lower transverse branches of each sub piece 72 are provided with toothed bumps, grooves matched with the toothed bumps are formed in the left and right sides of the master piece 71, and a rectangular groove is formed in the lower end of the master piece 71, so that the connecting piece 5 can be conveniently inserted.

In order to ensure firmness in connection, a vertical protection strip 62 is arranged on the right side edge of the fence 6, a vertical connecting piece 8 is arranged outside the vertical protection strip 62, and a groove connection manner is also adopted. The vertical connecting piece 8 is connected with the connecting piece 5 at the upper end of the fence 6 through an L-shaped connecting piece 9, one end of the L-shaped connecting piece 9 is inserted into the connecting piece 5, and the other end of the L-shaped connecting piece 9 is fixed on the vertical connecting piece 8 through a bolt. Ingenious design and firmness in connection are achieved.

In order to ensure mounting firmness of the column body, a base 21 is arranged at the lower end of the column body 2, the base 21 is positioned underground, the base 21 consists of four embedded parts c, the base 21 has a square section, the embedded parts c are fixed together through bolts, a lower sealing buckle 211 is mounted at the lower end of the base 21, and the lower sealing buckle 211 is square, and is matched with the section of the base 21. An embedded part end cap 22 is arranged at the upper end of the base 21, a buckle is arranged on one side of the embedded part end cap 22, the embedded part end cap 22 is positioned on the ground, and all the structures are intended to ensure firmness of the column body 2, and are precise in design and convenient to mount. The L-shaped connecting piece 9 is prepared from aluminium or rigid plastic, and the door and the column body are prepared from aluminium or rigid plastic. U-shaped grooves 23 are formed in three lateral surfaces of the column body 2, the enclosing wallboards are inserted into the U-shaped grooves 23, and the other grooves may be sealed. A ruler may be mounted in the column body 2, and a scale part of the ruler is exposed, so that depth measurement of a mounting worker is facilitated, and simple design and convenience are ensured.

The novel enclosing wallboard firm-connection device is time-saving, labour-saving, convenient to mount and transport and firm in mounting. The bolts are adopted for combination of the novel enclosing wallboard firm-connection device, so that the novel enclosing wallboard firm-connection device can be secondarily used, and has broad market prospect and huge economic benefits, the cost is reduced, the environment is protected, and aesthetics and practicability are combined. The novel enclosing wallboard firm-connection device is directly assembled, so that the parts are convenient to transport, and the novel enclosing wallboard firm-connection device is firm, convenient to mount, time-saving and more practical.

The embodiments only describe the technical concept and characteristics of the invention, aim to enable those skilled in the art to understand the contents of the invention and implement the invention on such a basis, and are not intended to limit the scope of protection of the invention. Any equivalent variation and modification made according to the essence of the contents of the invention shall fall within the scope of protection of the invention.

The invention claimed is:

1. A novel enclosing wallboard firm-connection device, comprising:

an enclosing wall consisting of a plurality of enclosing wallboards, a column body mounted on the enclosing wall, and a door mounted on the column body;

wherein a lower end cap is mounted at a lower end of the enclosing wall, a connecting piece is mounted on the lower end cap, the plurality of enclosing wallboards are inserted into the connecting piece;

a plurality of bumps are arranged at upper ends of the plurality of enclosing wallboards, a plurality of first grooves are formed at lower ends of the plurality of enclosing wallboards, the plurality of enclosing wallboards are combined together through the plurality of bumps and the plurality of first grooves;

a fence is mounted at an upper end of the enclosing wall, a plurality of protection strips are mounted on an upper edge and a lower edge of the fence, the connecting piece is mounted at an upper end of one of the plurality of protection strips on the upper edge of the fence;

an upper end cap is mounted at an upper end of the connecting piece, and the connecting piece is inserted into the upper end cap;

each protection strip of the plurality of protection strips on the lower edge of the fence is mounted on each enclosing wallboard of the plurality of enclosing wallboards through the connecting piece;

a plurality of oblique grooves are formed in the plurality of protection strips, the each protection strip is mounted on the fence through each oblique groove of the plurality of oblique grooves; and a plurality of U-shaped grooves are formed in three lateral surfaces of the column body, the plurality of enclosing wallboards are inserted into the plurality of U-shaped grooves.

2. The novel enclosing wallboard firm-connection device according to claim 1, wherein the door is connected with the column body through a plurality of hinges.

3. The novel enclosing wallboard firm-connection device according to claim 1, wherein the door consists of a doorframe and a door sheet, the doorframe is fixed through a plurality of L-shaped connecting pieces, and the door sheet is directly fixed on the doorframe.

4. The novel enclosing wallboard firm-connection device according to claim 1, wherein the connecting piece comprises a component a and a component b, an upper traverse branch and a lower transverse branch of the component a are provided with a plurality of toothed bumps, a plurality of second grooves matched with the plurality of toothed bumps are formed in the component b, and a rectangular groove is formed in a lower end of the component b.

5. The novel enclosing wallboard firm-connection device according to claim 1, wherein the upper end cap comprises a master piece and two sub pieces, an upper transverse branch and a lower transverse branches of each sub piece are provided with a plurality of toothed bumps, a plurality of second, grooves matched with the plurality of toothed bumps are formed in a left side and a right side of the master piece, and a rectangular groove is formed in a lower end of the master piece.

6. The novel enclosing wallboard firm-connection device according to claim 1, wherein a vertical protection strip is arranged on a right side edge of the fence, a vertical connecting piece is arranged outside the vertical protection strip, the vertical connecting piece is connected with the connecting piece at the upper end of the fence through an L-shaped connecting piece, a first end of the L-shaped connecting piece is inserted into the connecting piece, and a second end of the L-shaped connecting piece is fixed on the vertical connecting piece through a bolt.

7. The novel enclosing wallboard firm-connection device according to claim 1, wherein a base is arranged at a lower end of the column body, the base is positioned underground, the base consists of four embedded parts, the base has a square section, the four embedded parts are fixed together through a plurality of bolts, a lower sealing buckle is mounted at a lower end of the base, and the lower sealing buckle is square, and the lower sealing buckle is matched with the square section of the base.

8. The novel enclosing wallboard firm-connection device according to claim 7, wherein an embedded part end cap is arranged at an upper end of the base, a buckle is arranged on one side of the embedded part end cap, and the embedded part end cap is positioned on the ground.

9. The novel enclosing wallboard firm-connection device according to claim 3, wherein the plurality of L-shaped connecting pieces are prepared from an aluminium or a rigid plastic, and the door and the column body are prepared from an aluminium or a rigid plastic.

* * * * *